US008767024B2

(12) United States Patent
Wang et al.

(10) Patent No.: US 8,767,024 B2
(45) Date of Patent: Jul. 1, 2014

(54) DISPLAY APPARATUS AND OPERATION METHOD THEREOF

(75) Inventors: Yi-Hao Wang, Hsin-Chu (TW); Kai-Yuan Siao, Hsin-Chu (TW)

(73) Assignee: Au Optronics Corp., Hsin-Chu (TW)

( * ) Notice: Subject to any disclaimer, the term of this patent is extended or adjusted under 35 U.S.C. 154(b) by 184 days.

(21) Appl. No.: 13/556,308

(22) Filed: Jul. 24, 2012

(65) Prior Publication Data

US 2013/0314389 A1 Nov. 28, 2013

(30) Foreign Application Priority Data

May 22, 2012 (TW) ..... 101118255 A

(51) Int. Cl.
*G09G 5/10* (2006.01)

(52) U.S. Cl.
USPC ..... 345/690; 345/211; 345/691

(58) Field of Classification Search
None
See application file for complete search history.

(56) References Cited

U.S. PATENT DOCUMENTS

| | | | | |
|---|---|---|---|---|
| 7,639,312 | B2 * | 12/2009 | Baba et al. | 348/790 |
| 8,570,351 | B2 * | 10/2013 | Mori et al. | 345/690 |
| 2002/0186193 | A1 | 12/2002 | Lee et al. | |
| 2004/0070590 | A1 * | 4/2004 | Lee et al. | 345/690 |
| 2008/0204444 | A1 | 8/2008 | Ryu et al. | |
| 2011/0292092 | A1 * | 12/2011 | Ozawa | 345/690 |

* cited by examiner

*Primary Examiner* — Adam R Giesy
(74) *Attorney, Agent, or Firm* — WPAT, PC; Justin King

(57) ABSTRACT

A display apparatus with a display panel is provided. The display panel is initially driven to have the data voltages on any two consecutive data lines thereon with different polarities. If a to-be-displayed image contains a predetermined pattern constituted by pixels in row and two adjacent pixels therein have a gray-level difference therebetween greater than a predetermined value, a timing control circuit of the display apparatus divides the associated data lines into a plurality of data line groups each constituted by four consecutive data lines and configure the data voltages on the two middle data lines in one data line group to have a first polarity and the data voltages on the rest two data lines in the same data line group to have a second polarity. An operation method of the display apparatus is also provided.

16 Claims, 10 Drawing Sheets

DISPLAY APPARATUS AND OPERATION METHOD THEREOF

TECHNICAL FIELD

The disclosure relates to a display technical field, and more particularly to a display apparatus and an operation method thereof.

BACKGROUND

FIG. 1 is a schematic view of a display panel with half-source-driving structure. As shown, the display panel 100 in this embodiment includes a plurality of data lines 102, a plurality of scan lines 104 and a plurality of sub-pixels 106 arranged in a matrix manner. Specifically, each same-column sub-pixel 106 is configured to be electrically connected to one and the same data line 102; each same-row sub-pixel 106 is configured to be electrically connected to two of the scan lines 104, and the sub-pixels 106 electrically connected to the two scan lines 104 are configured to have an intersecting arrangement. In addition, each pixel is constituted by three colors of sub-pixels 106, namely R (red), G (green) and B (blue). As illustrated in FIG. 1, the first three R, G and B sub-pixels 106 in the first row corporately constitute one pixel, and the next three R, G and B sub-pixels 106 in the first row corporately constitute another one pixel.

However, the crosstalk issue may occur in some areas of the display panel 100 while the display panel 100 is displaying an image containing a specific pattern. The occurrence of the crosstalk on the display panel 100 will be described in detail in the following description with reference to FIG. 2.

FIG. 2 is a schematic simulation view illustrating the occurrence of the crosstalk on the display panel 100 while the display panel 100 is displaying an image containing the aforementioned specific pattern. As shown, an area 110 (indicated by dotted lines) on the display panel 100 is an area corresponding to the specific patterns. Each specific pattern is constituted by four pixels in row; specifically, the first two pixels each have a black color (indicated with slash lines), and the consequent two pixels each have a white color (indicated with nothing). In addition, it is understood the first two pixels, as well as the sub-pixels 106 therein, in this specific pattern each have the lowest gray level due to having a black color; and the flowing two pixels, as well as the sub-pixels 106 therein, each have the highest gray level due to having a white color. Moreover, to emphasize the crosstalk effect on the display panel 100, the pixels in the rest area (except the area 110) are exemplified by having other colors (for example, a gray color) and are indicated with dots.

As illustrated in FIG. 2, because the specific patterns are contained in the image being displayed, the crosstalk may occur in some areas on the display panel 100, specifically, the areas within the area 110 and the areas 120-1, 120-2 respectively on the right and left sides of the area 110.

SUMMARY OF EMBODIMENTS

Therefore, one object of the present disclosure is to provide a display apparatus capable of eliminating the crosstalk resulted from a specific pattern.

Another object of the present disclosure is to provide an operation method for the aforementioned display apparatus.

An embodiment of the present disclosure provides a display apparatus, which includes a display panel, a data driving circuit (constituted by a plurality of data driving chips), a scan driving circuit and a timing control circuit. The display panel includes a plurality of data lines, a plurality of scan lines and a plurality of sub-pixels. The sub-pixels are arranged in a matrix manner, and each sub-pixel is electrically connected to one of the data lines and one of the scan lines. The data driving circuit is electrically connected to the data lines; the scan driving circuit is electrically connected to the scan lines; and the timing control circuit is electrically connected to the data driving circuit and the scan driving circuit. The timing control circuit is configured to control the scan driving circuit to drive the scan lines and control the data driving circuit to output data voltages to the data lines; wherein the data voltages on any two consecutive data lines initially are configured to have different polarities while the data lines are being supplied with data voltages from the data driving circuit. The timing control circuit is further configured to judge a to-be-displayed image whether or not containing an area for displaying a predetermined pattern constituted by a plurality of pixels in row; wherein at least one of the pixels in the predetermined pattern has a first gray level, another one pixel adjacent to the pixel has a second gray level, and the first and second gray levels have a gray-level difference therebetween greater than or equal to a predetermined value. The timing control circuit is further configured to, if the to-be-displayed image contains the area corresponding to the predetermined pattern, divide the data lines associated with the area into a plurality of data line groups each constituted by four consecutive data lines and configure, while the data driving circuit outputs the data voltages associated with the area, data voltages on the two middle data lines in one data line group to have a first polarity and the data voltages on the rest two data lines in the same data line group to have a second polarity.

Another embodiment of the present disclosure provides an operation method of a display apparatus. The display apparatus includes a display panel. The display panel includes a plurality of data lines, a plurality of scan lines and a plurality of sub-pixels. The sub-pixels are arranged in a matrix manner, and each sub-pixel is electrically connected to one of the data lines and one of the scan lines. The operation method includes steps of: providing data voltages with specific polarity to the data lines, wherein the data voltages on any two consecutive data lines have different polarities; determining a to-be-displayed image whether or not having an area for displaying a predetermined pattern constituted by a plurality of pixels in row, wherein in this predetermined pattern at least one pixel has a first gray level, one adjacent pixel has a second gray pixel, and the first and second pixel grays have a gray-level difference therebetween greater than or equal to a predetermined value; and diving, if the to-be-display image having the area for displaying the predetermined pattern, the data lines associated with the area into a plurality of data line groups each including four consecutive data lines, and supplying first-polarity data voltage to the two middle consecutive data lines and supplying second-polarity data voltage to the rest two data lines in each data line group.

In summary, according to the present disclosure, a display panel is driven initially by a general-driving mean, which indicates that the data voltages on any two consecutive data lines have different polarities, and then a to-be-displayed image is determined whether or not containing a specific pattern, which is constituted by a plurality of pixels in row; wherein in this predetermined pattern at least one pixel has a first gray level, one adjacent pixel has a second gray pixel, and the first and second pixel grays have a gray-level difference greater than or equal to a predetermined value. Afterwards, another driven mean is adopted for the driving of the display panel if the specific pattern is contained in the to-be-displayed image; specifically, the data lines associated with the specific patterns are divided into a plurality of data line groups each including four consecutive data lines, and in each data line group the data voltages on the two middle consecutive data lines have the same polarity and the data voltages on the rest two data lines have another same polarity.

BRIEF DESCRIPTION OF THE DRAWINGS

The above embodiments will become more readily apparent to those ordinarily skilled in the art after reviewing the following detailed description and accompanying drawings, in which.

DETAILED DESCRIPTION OF EMBODIMENTS

The disclosure will now be described more specifically with reference to the following embodiments. It is to be noted that the following descriptions of preferred embodiments are presented herein for purpose of illustration and description only. It is not intended to be exhaustive or to be limited to the precise form disclosed.

Figure 1:
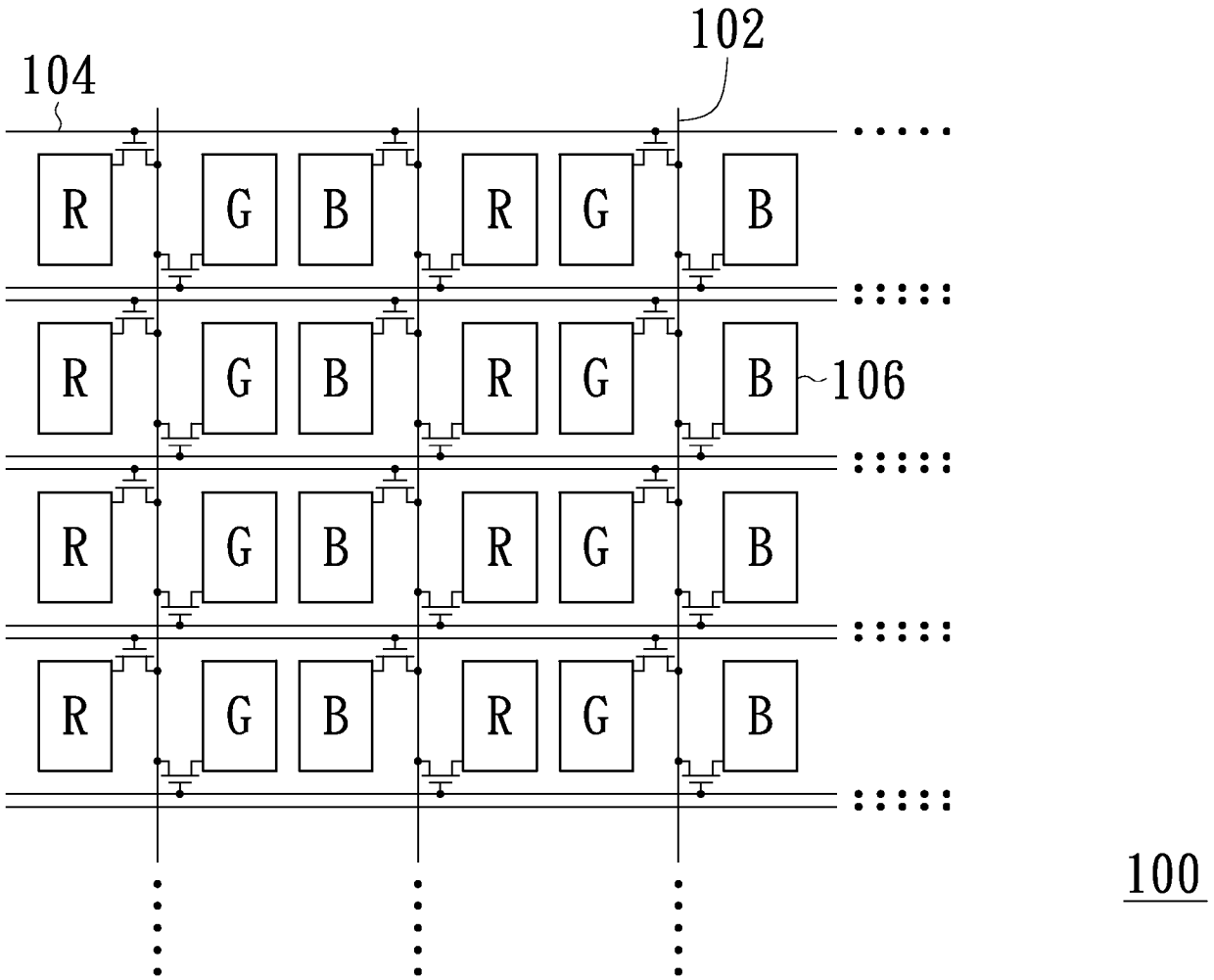
FIG. 1 (Prior Art)
FIG. 1 is a schematic view of a display panel with half-source-driving structure.
Figure 2:
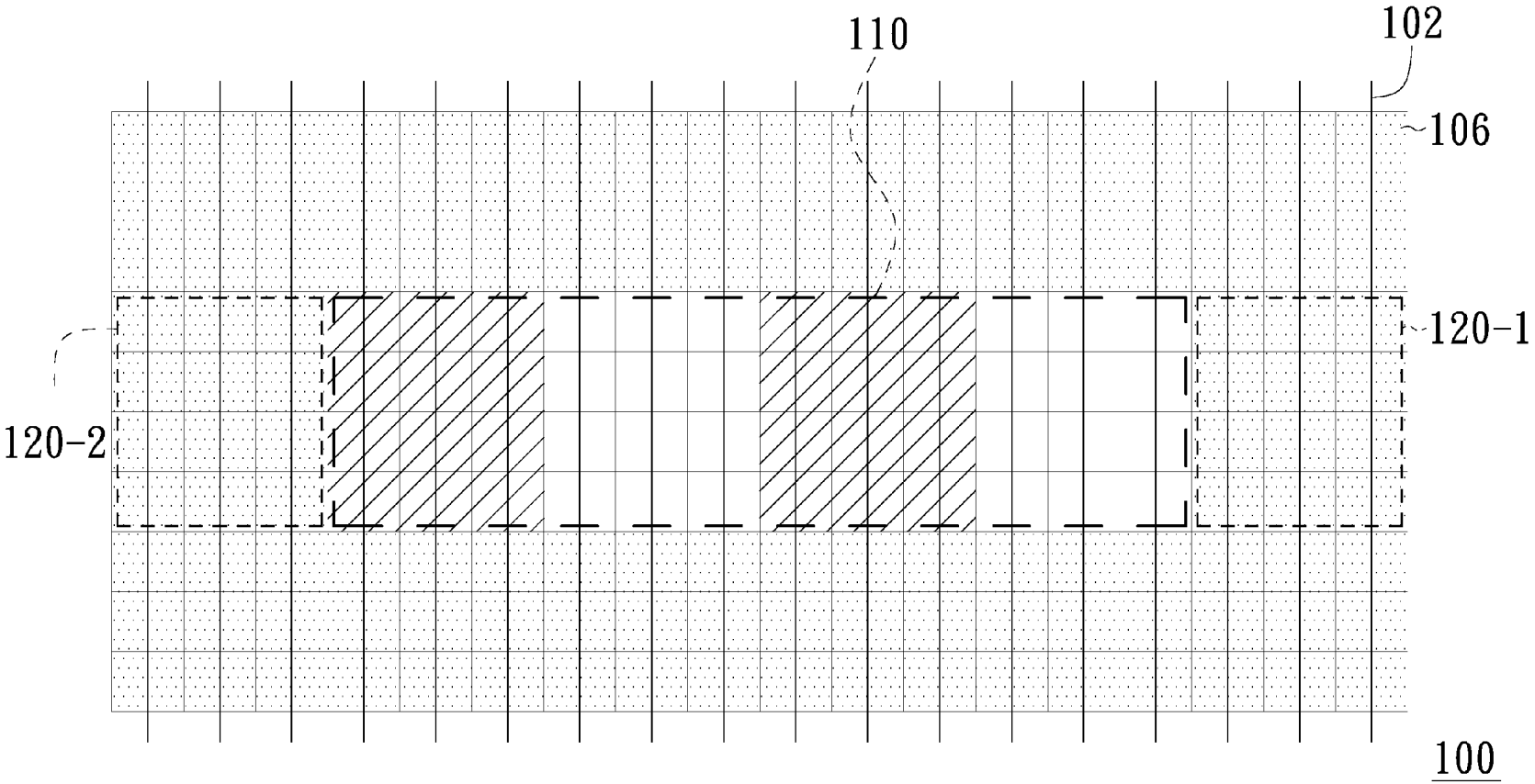
FIG. 2 (Prior Art)
FIG. 2 is a schematic simulation view illustrating the occurrence of the crosstalk on the display panel in FIG. 1 while the display panel is displaying an image containing the aforementioned specific pattern.
Figure 3:
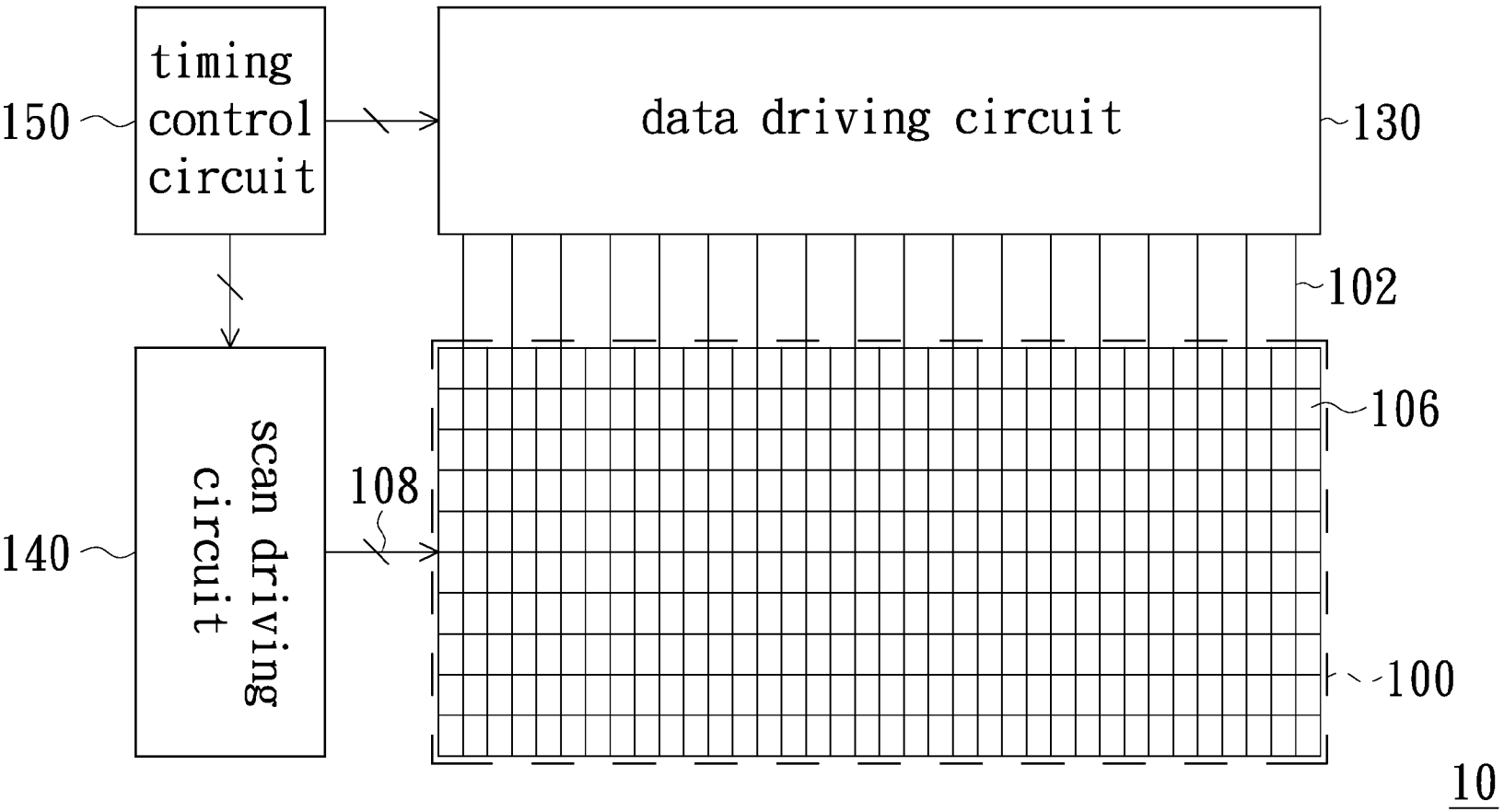
FIG. 3 is a schematic view of a display apparatus in accordance with an embodiment of the present disclosure.

FIG. 3 is a schematic view of a display apparatus in accordance with an embodiment of the present disclosure. As shown, the display apparatus 10 in this embodiment includes a display panel 100, a data driving circuit 130, a scan driving circuit 140 and a timing control circuit 150. The display panel 100 with half-source-driving structure includes a plurality of data lines 102, a plurality of scan lines (to make FIG. 3 neater, the scan lines herein are presented by a scan line bus 108) and a plurality of sub-pixels 106 arranged in a matrix manner. In addition, the data driving circuit 130 is electrically connected to the data lines 102; the scan driving circuit 140 is electrically connected to the scan lines of the scan line bus 108; and the timing control circuit 150 is electrically connected to the data driving circuit 130 and the scan driving circuit 140.

The timing control circuit 150 is configured to control the scan driving circuit 140 to drive the scan lines of the scan line bus 108 and initially drive the data driving circuit 130 by a general-driving mean to output data voltages to the data lines 102 and thereby driving the display panel 100 to display images. The general-driving mean herein is referred to as configuring, when the data driving circuit 130 is outputting data voltages to the data lines 102, the data voltages on any two consecutive data lines 102 to have different polarities. However, if the scan driving circuit 140 is driven by a general-driving method and an area of a to-be-displayed image contains the specific pattern (i.e., BBWW pixels in row), the crosstalk issue may occur in a specific area of the to-be-displayed image. The crosstalk occurrence will become apparent from the following detailed description with reference to FIG. 4.

Figure 4:
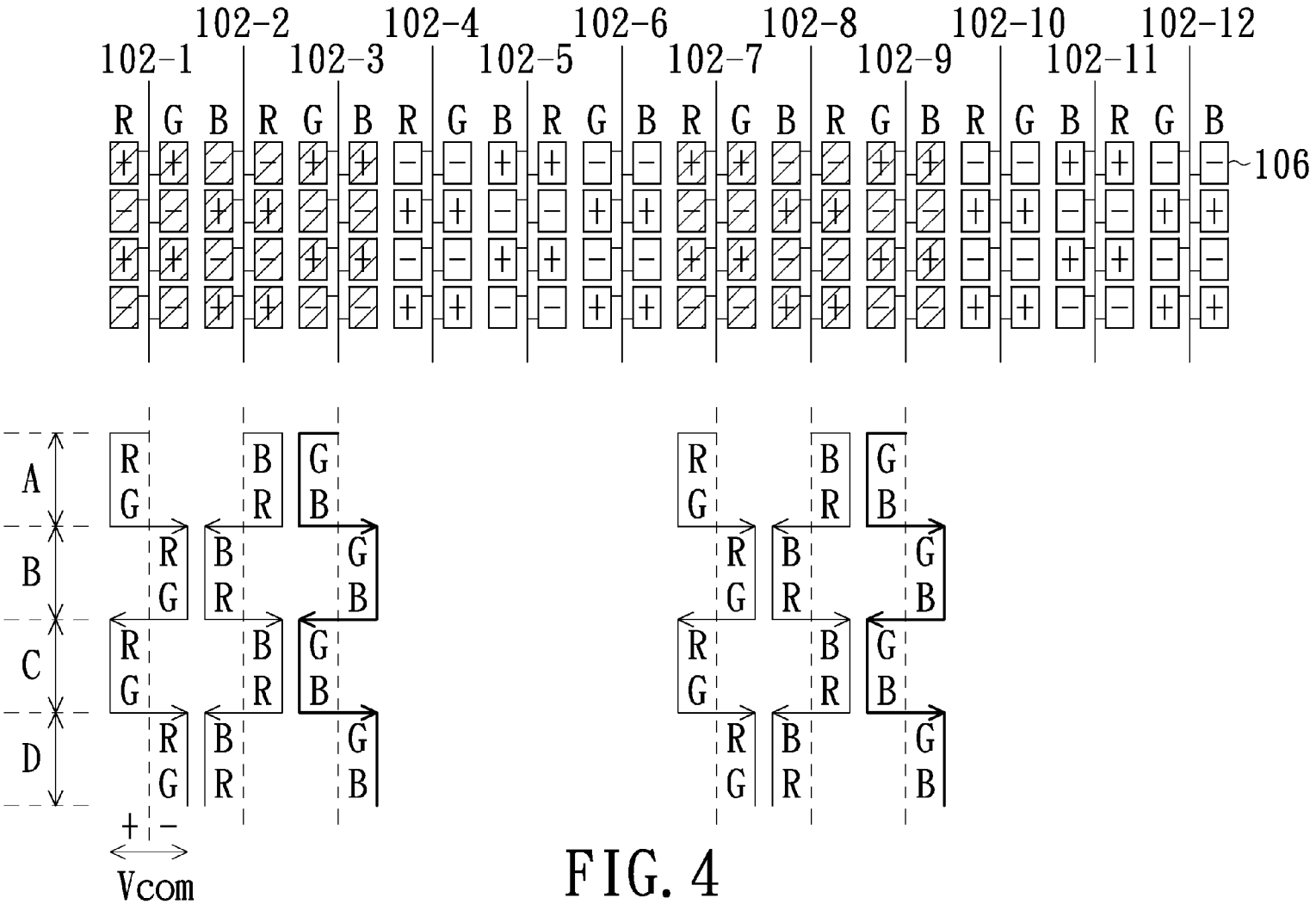
FIG. 4 is a schematic view illustrating the sub-pixels and the data lines associated with the area of the display panel in FIG. 3 corresponding to specific patterns.

FIG. 4 is a schematic view illustrating the sub-pixels 106 and the data lines 102 associated with the area of the display panel 100 corresponding to the specific patterns (i.e., BBWW pixels in row). As shown, the sub-pixels 106 associated with the area are arranged in a matrix manner, and the associated twelve data lines 102 are specifically indicated with 102-1~102-12, respectively. In addition, there are marks of R, G and B above the first row of sub-pixel 106. Specifically, a column of sub-pixel 106 is indicated with a mark of R if the column of sub-pixel 106 is constituted by all red sub-pixels; a column of sub-pixel 106 is indicated with a mark of G if the column of sub-pixel 106 is constituted by all green sub-pixels; and a column of sub-pixel 106 is indicated with a mark of B if the column of sub-pixel 106 is constituted by all blue sub-pixels. Moreover, the marks of "+", "−" in the sub-pixel 106 indicate the polarity of the data voltage supplied therein.

In addition, as illustrated in FIG. 4, some data lines 102 are further illustrated with respective data voltage swings; wherein the voltage level of the common voltage Vcom is indicated with dotted lines. Specifically, a sub-pixels 106 is indicated with a mark of "+" if the data voltage supplied therein is greater than the common voltage Vcom; alternatively, with a mark of "−" if the data voltage supplied therein is smaller than the common voltage Vcom. Moreover, because this specific area as depicted in FIG. 4 is exemplified by having four rows of sub-pixels 106, the data voltage swing on each data line 102 is, while the scan driving circuit 140 is sequentially driving the four rows of sub-pixel 106, divided into four phases A, B, C and D. It is to be noted that the voltage supplied in a sub-pixel 106 of a white pixel and that of a black pixel are configured to have different swing amplitudes in this embodiment.

Please refer to FIG. 4 again. To those black pixels, the coupling effects resulted from the data voltages on the two consecutive pixel data lines 102-1, 102-2 to the common voltage Vcom can cancel each other out by configuring the two data voltages in two opposite swing manner; likewise, the coupling effects resulted from the data voltages on the two consecutive pixel data lines 102-7, 102-8 to the common voltage Vcom can cancel each other out by configuring the two data voltages in two opposite swing manner. However, the coupling effects resulted from the data voltages on the two pixel data lines 102-3, 102-9 to the common voltage Vcom cannot cancel each other out due to the two data voltages having the same swing manner. It is understood that the aforementioned coupling effect occurrence and canceling with respect to black pixels are also applied to those white pixels, and no unnecessary detail is given here. Because the coupling effects resulted from some of the data lines 102-1~102-12 in this specific area as illustrated in FIG. 4 cannot cancel each other out, eventually these accumulated cannot-cancel-each-other coupling effects may result in the crosstalk in some areas on the display panel 100, specifically, the areas within and on the right and left sides of the area depicted in FIG. 4.

To prevent the crosstalk from occurring on the display panel 100 while an image containing the specific pattern (i.e., BBWW pixels in row) is being displayed, in this embodiment the timing control circuit 150 is configured to judge a to-be-displayed image whether or not containing the specific pattern (i.e., BBWW pixels in row) first, and then determine, according to the judgment result, whether or not to adopt another driving mean for the elimination of the crosstalk; wherein the related details will be described later. In other words, the timing control circuit 150 first judges a to-be-displayed image whether or not containing a predetermined pattern consecutively constituted by two black and two white pixels in row (i.e., BBWW pixels in row); that is, the timing control circuit 150 is configured to judge a to-be-displayed image whether or not containing four consecutive pixels in row respectively having the lowest, lowest, highest and highest gray levels. In addition, it is understood that if a pixel has the lowest gray level, the sub-pixels therein each also have the lowest gray level; and if a pixel has the highest gray level, the sub-pixels therein each also have the highest gray level.

Figure 5:
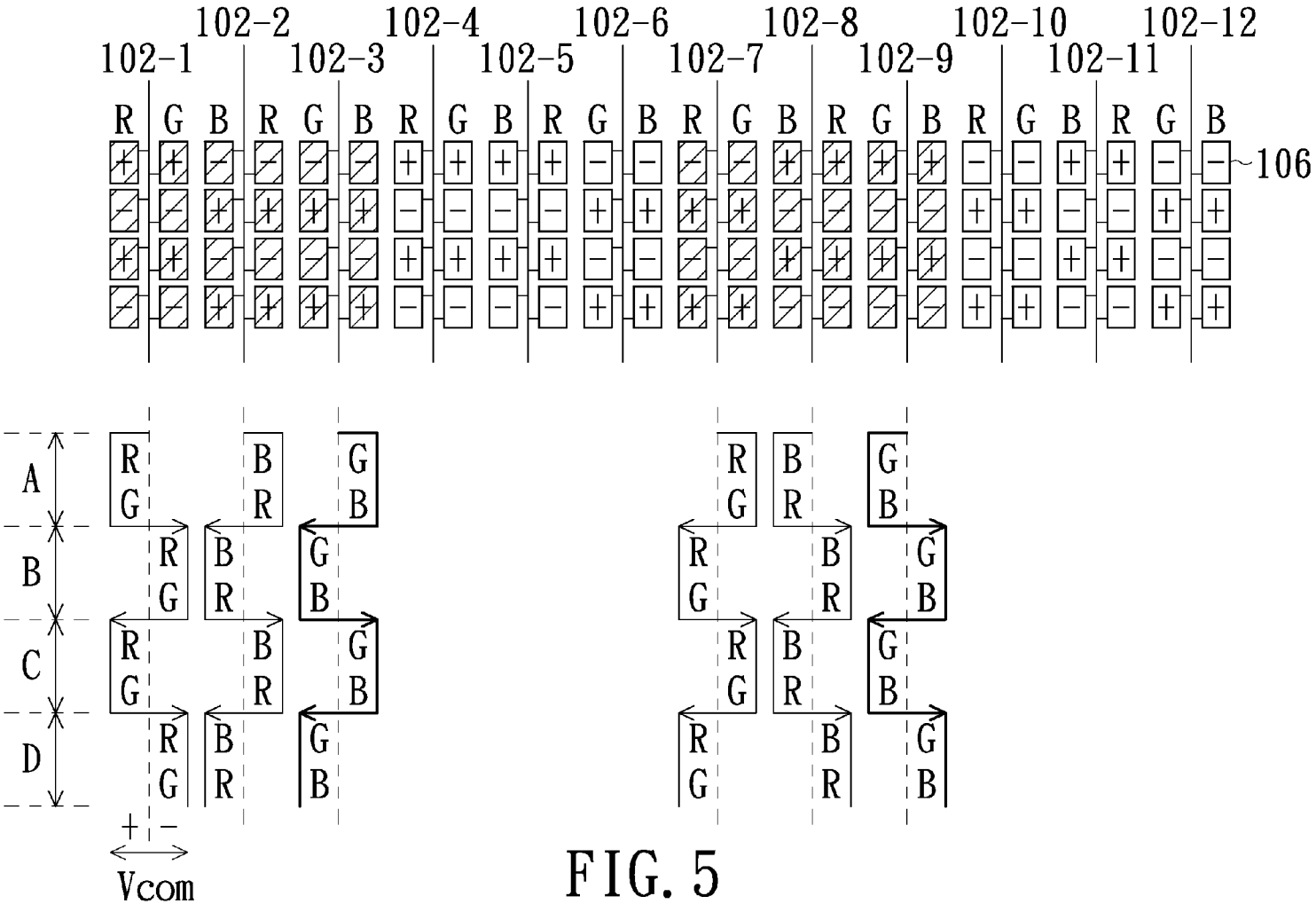
FIG. 5 is a schematic view illustrating the sub-pixels and the data lines associated with the area of the display panel in FIG. 3 corresponding to the specific patterns.

Once the specific pattern (i.e., BBWW pixels in row) is detected in the to-be-displayed image, the timing control circuit 150 is configured to adopt another driving method, instead of the general-driving method, to drive the display panel 200. For example, as illustrated in FIG. 5 which is a schematic view illustrating the sub-pixels 106 and the data lines 102 associated with an area of the display panel 100 corresponding to an image containing the specific patterns (i.e., BBWW pixels in row). As shown, the timing control circuit 150 first divides the associated data lines 102-1~102-12 into a plurality of (for example, three) data line groups and each data line group includes a plurality of (for example, four) consecutive data lines 102. In this example, the four consecutive data lines 102-1~102-4 are divided into one data line group; the four consecutive data lines 102-5~102-8 are divided into another one data line group; and the four consecutive data lines 102-9~102-12 are divided into still another one data line group.

Afterwards, the timing control circuit 150 controls the data driving circuit 130 to output data voltages with specific polarity to each data line group of four consecutive data lines 102; specifically, the two middle data lines 102 are configured to have the same polarity and the rest two data lines 102 are configured to have another same polarity. In addition, in this embodiment the data voltages sequentially supplying to any two consecutive sub-pixels 106 electrically connected to one and the same data line 102 are configured to have different polarities. For example, as illustrated in FIG. 5, in one data line group the data voltages on the two middle data lines 102-2, 102-3 in phase A are configured to have the same polarity (e.g., polarity "−"), and in the same phase A the rest two data lines 102-1, 102-4 are configured to have the another same polarity (e.g., polarity "+"). Likewise, in another one data line group the data voltages on the two middle data lines 102-6, 102-7 in phase A are configured to have the same polarity (e.g., polarity "−"), and in the same phase A the rest two data lines 102-5, 102-8 are configured to have the another same polarity (e.g., polarity "+"). Likewise, in still another one data line group the data voltages on the two middle data lines 102-10, 102-11 in phase A are configured to have the same polarity (e.g., polarity "−"), and in the same phase A the rest two data lines 102-9, 102-12 are configured to have the another same polarity (e.g., polarity "+"). In addition, it is understood that the aforementioned data voltage polarity configuration in the phase A can be also applied to the phases B, C and D each.

Please refer to FIG. 5 again. To those black pixels, the coupling effects, resulted from the data voltages on the two consecutive pixel data lines 102-1, 102-2, on the common voltage Vcom can cancel each other out by configuring the two data voltages in two opposite swing manner; likewise, the coupling effects, resulted from the data voltages on the two consecutive pixel data lines 102-7, 102-8, on the common voltage Vcom can cancel each other out by configuring the two data voltages in two opposite swing manner. In addition, the coupling effects, resulted from the data voltages on the two pixel data lines 102-3, 102-9, on the common voltage Vcom can cancel each other out by configuring the two data voltages in two opposite swing manner. It is understood that the aforementioned coupling effect occurrence and canceling with respect to black pixels are also applied to those white pixels; and no unnecessary detail is given here. Therefore, through employing the aforementioned data voltage polarity configuration, all the coupling effects resulted from the data lines 102-1~102-12 can cancel each other out and consequently the crosstalk is eliminated on the display panel 100.

Not only the display panel with half-source-driving structure has the crosstalk issue while being driven by a general-driving mean to display an image containing a specific pattern (i.e., BBWW pixels in row), the crosstalk issue also occurs on the zigzag-structured display panel while being driven to display an image containing another specific pattern by a general-driving mean. The structure of the zigzag-structured display panel will be described in detail first in the following description with reference to FIG. 6.

Figure 6:
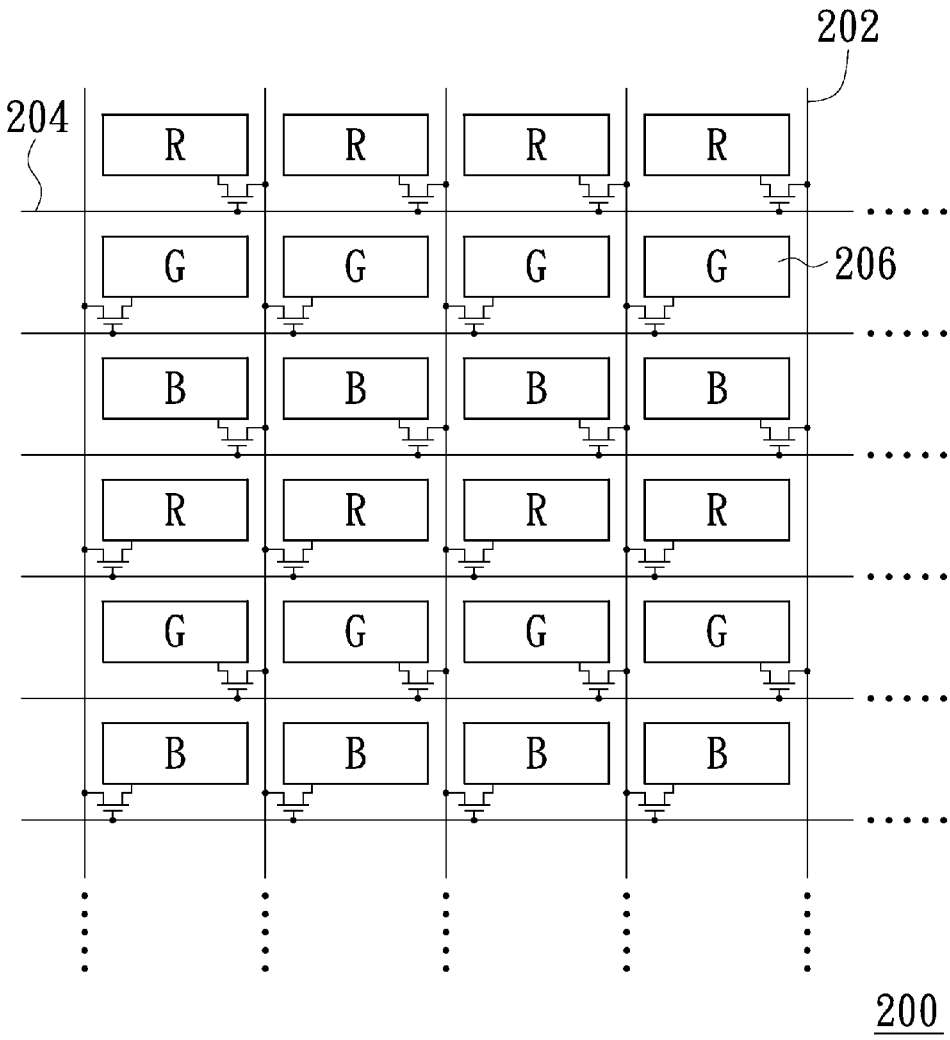
FIG. 6 is a schematic view of a display panel with zigzag structure.

FIG. 6 is a schematic view of a display panel with zigzag structure. As shown, the display panel 200 includes a plurality of data lines 202, a plurality of scan lines 204 and a plurality of sub-pixels 206 arranged in a matrix manner. Specifically, each same-row sub-pixel 206 is configured to be electrically connected to one and the same scan line 204; each same-column sub-pixels 206 is configured to be electrically connected to one of two adjacent data lines 202, and the sub-pixels 206 in the same column have an intersecting arrangement with respective to the two associated data lines 202. In addition, it is understood that the sub-pixels 206 each have a red, green or blue color. As depicted in FIG. 6, the red sub-pixel 206 is indicated with a mark of R; the green sub-pixel 206 is indicated with a mark of G; and the blue sub-pixel 206 is indicated with a mark of B. In addition, one red sub-pixel 206, one green sub-pixel 206 and one blue sub-pixel 206 corporately constitute one pixel. For example, the first three sub-pixels 206 in the first column corporately constitute one pixel; and the following next three sub-pixels 206 in the first column corporately constitute another one pixel.

As mentioned above, the crosstalk occurs on the zigzag-structured display panel 200 if the zigzag-structured display panel 200 is driven by a general-driving mean to display an image containing another specific pattern. The occurrence of the crosstalk on the zigzag-structured display panel 200 will be described in detail in the following description with reference to FIG. 7.

Figure 7:
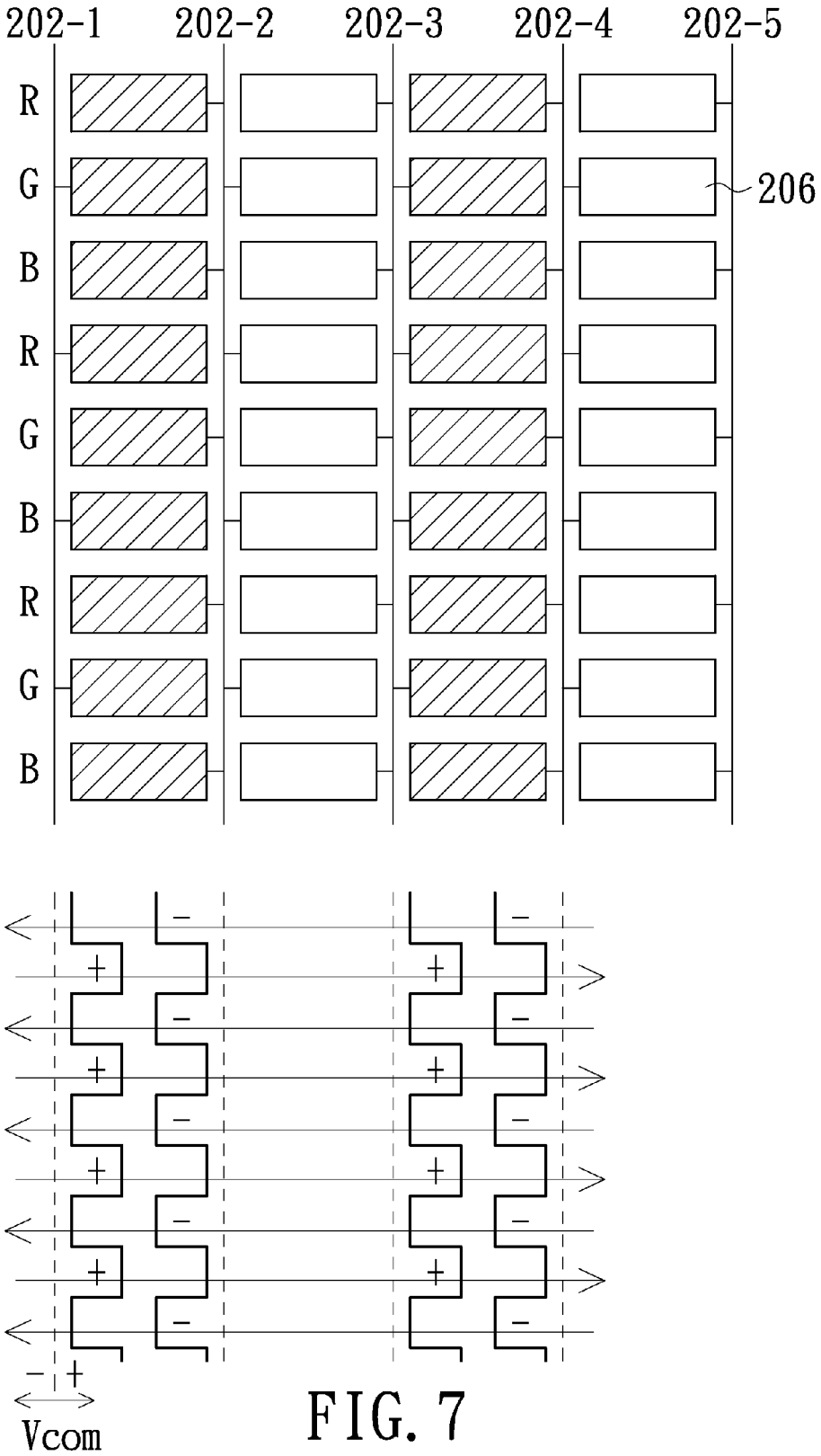
FIG. 7 is a schematic view illustrating the sub-pixels and the data lines associated with the area of the display panel in FIG. 6 corresponding to another specific patterns.

FIG. 7 is a schematic view illustrating the sub-pixels 206 and data lines 202 associated with the area of the display panel 200 corresponding to the aforementioned another specific patterns. As shown, the sub-pixels 206 associated with the area are arranged in a matrix manner, and the five data lines 202 associated with the area are specifically indicated with 202-1~202-5, respectively. In addition, there are marks of R, G and B on the left of the first column of sub-pixels 206; specifically, a row of sub-pixel 206 is indicated with a mark of R if the row of sub-pixel 106 is constituted by all red sub-pixels, a row of sub-pixel 206 is indicated with a mark of G if the row of sub-pixel 206 is constituted by all green sub-pixels, and a row of sub-pixel 206 is indicated with a mark of B if the row of sub-pixel 206 is constituted by all blue sub-pixels.

As illustrated in FIG. 7, the aforementioned another specific pattern is constituted by two consecutive pixels in row; wherein the first pixel has a black color (indicated with slash lines) and the second pixel has a white color (indicated with nothing). In addition, it is understood the first pixel, as well as the three sub-pixels 206 therein, in this another specific pattern has the lowest gray level due to having a black color; and the second pixel, as well as the three sub-pixels 206 therein, has the highest gray level due to having a white color.

In addition, as shown in FIG. 7, some data lines 202 are further illustrated with respective data voltage swings; wherein the voltage level of the common voltage Vcom is indicated with dotted lines. Specifically, a sub-pixels 206 is indicated with a mark of "+" if the data voltage supplied therein is greater than the common voltage Vcom; alternatively, with a mark of "−" if the data voltage supplied therein is smaller than the common voltage Vcom. Moreover, because the area corresponding to the other specific patterns is exemplified by having nine rows of sub-pixels 206, the data voltage swing on each of the data lines 202-1~202-5 is, while the nine rows of sub-pixel 206 are being supplied sequentially data voltages, divided into nine phases.

According to the data voltage swing configuration as illustrated in FIG. 7, the display panel 200 is driven by a general-driving mean initially. In other words, the data voltages on any two consecutive data lines 202 on the display panel 200 are configured to have different polarities. It is to be noted that the voltage supplied in a sub-pixel 206 associated with a white (or, highest gray-level) pixel and that associated with a black (or, lowest gray-level) pixel are configured to have different swing amplitudes in this embodiment.

Please refer to FIG. 7 again. The sum of negative-polarity data voltages, supplied to the first row of sub-pixel 206, is greater than the sum of positive-polarity data voltages; and accordingly the coupling effect, resulted from the negative-polarity data voltages, on the common voltage Vcom occurs (indicated with an arrow toward left). Likewise, the sum of positive-polarity data voltages, supplied to the second row of sub-pixel 206, is greater than the sum of negative-polarity data voltages; and accordingly the coupling effect, resulted from the positive-polarity data voltages, on the common voltage Vcom occurs (indicated with an arrow toward right).

In other words, because the two data lines 202-1, 202-3 are configured to have the same data voltage swing, the coupling effects, resulted from the data voltages on the two data lines 202-1, 202-3, on the common voltage Vcom cannot cancel each other out. Likewise, the coupling effects, resulted from the data voltages on the two data lines 202-2, 202-4, on the common voltage Vcom cannot cancel each other. Eventually, these accumulated cannot-cancel-each-other coupling effects may result in the crosstalk in some areas on the display panel 200, specifically, the areas within and on the right and left sides of the area depicted in FIG. 7.

To prevent the crosstalk from occurring on the display panel 200 while an image containing the another specific pattern (i.e., BW pixels in row) is being displayed thereon, the timing control circuit according to the present disclosure is configured to judge a to-be-displayed image whether or not containing the another specific pattern (i.e., BW pixels in row) first, and then determine, according to the judgment result, whether or not to adopt another driving mean for this to-be-displayed image so as to eliminate the crosstalk; wherein the related details will be described later. In other words, the timing control circuit first judges a to-be-displayed image whether or not containing a predetermined pattern constituted consecutively by one black and one white pixels in row (i.e., BW pixels in row); that is, the timing control circuit is configured to judge a to-be-displayed image whether or not containing two consecutive pixels in row respectively having the lowest and highest gray levels. In addition, it is understood that if a pixel has the lowest gray level, the sub-pixels therein each also have the lowest gray level; and if a pixel has the highest gray level, the sub-pixels therein each also have the highest gray level.

Figure 8:
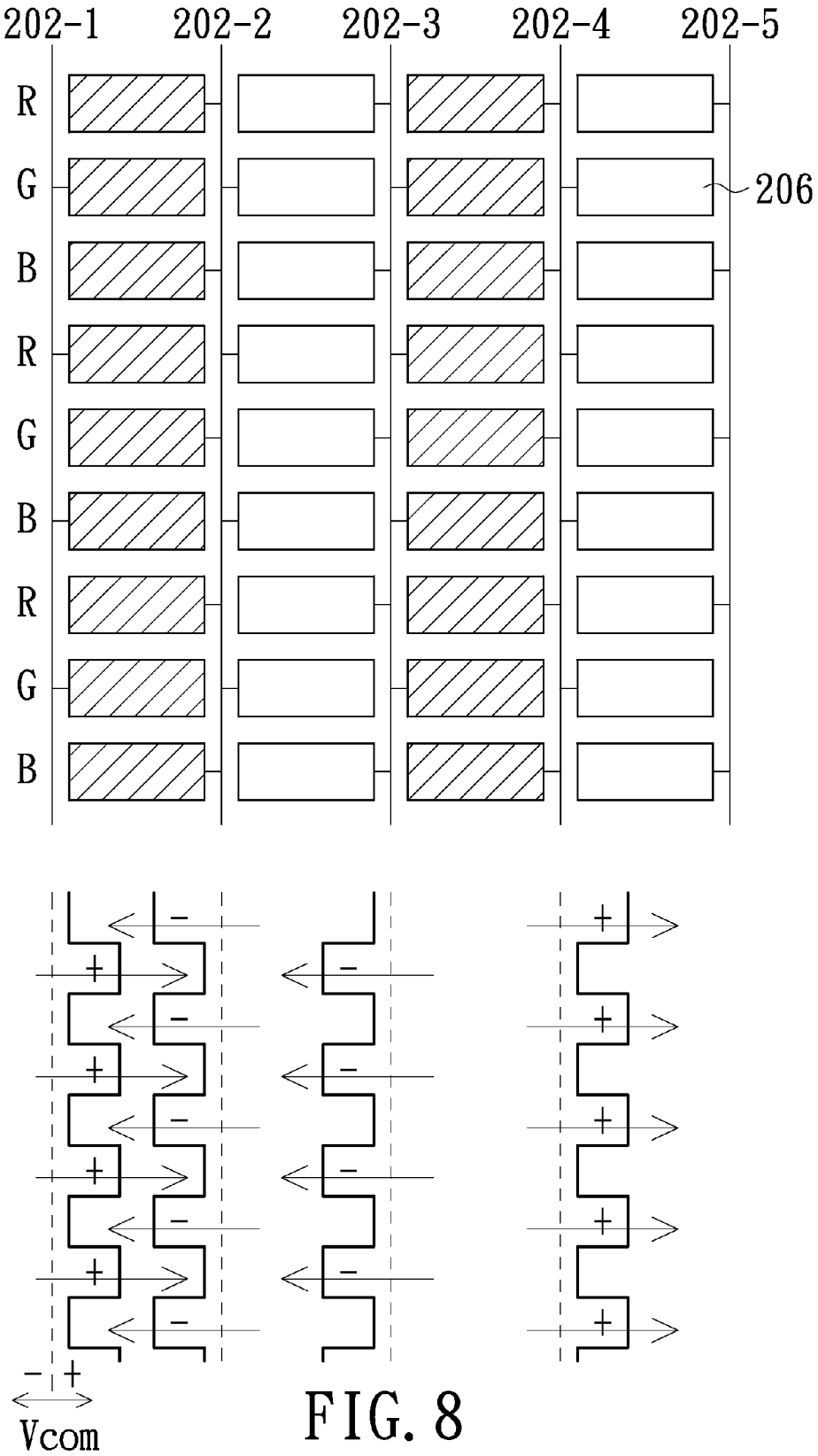
FIG. 8 is a schematic view illustrating the sub-pixels and the data lines associated with the area of the display panel in FIG. 6 corresponding to the another specific patterns.

Once the other specific pattern (i.e., BW pixels in row) is detected in the to-be-displayed image, the timing control circuit is configured to adopt another driving mean, instead of the general-driving mean, for the driving of the display panel 200. For example, as illustrated in FIG. 8 which is a schematic view illustrating the sub-pixels 206 and the data lines 202 associated with an area of the display panel 200 corresponding to an image containing the another specific patterns (i.e., BW pixels in row), the timing control circuit first divides the associated data lines 202-1~202-5 into a plurality of (for example, two) data line groups and each data line group includes a plurality of (for example, four) consecutive data lines 202. In this embodiment, the four consecutive data lines 202-1~202-4 are exemplified to be divided into one data line group; and the data line 202-5 is exemplified to be divided into another one data line group.

Then, the timing control circuit controls the data driving circuit to output data voltages with specific polarities to each data line group of four consecutive data lines 202; specifically, in each data line group the middle two of the data lines 202 (e.g., data lines 202-2, 202-3) are configured to have the same polarity and the rest two data lines 202 (e.g., data lines 202-1, 202-4) are configured to have another same polarity. In addition, it is understood that the data lines 202-5 is referred to as the first data line 202 in another data line group; in other words, the data lines 202-5 has a data voltage polarity configuration same as the data line 202-1 has.

Please refer to FIG. 8 again. As the illustration of the data voltage swings associated with the first row of sub-pixel 206, the coupling effects, resulted from the data voltages on the two pixel data lines 202-1, 102-3, on the common voltage Vcom can cancel each other out; and the coupling effects, resulted from the data voltages on the two pixel data lines 202-2, 202-4, on the common voltage Vcom can cancel each other out. Thus, the crosstalk resulted from the four data lines 202-1~202-4 in the first phase is eliminated. Likewise, as the illustration of the data voltage swings associated with the second row of sub-pixel 206, the coupling effects, resulted from the data voltages on the two pixel data lines 202-1, 102-3, on the common voltage Vcom can cancel each other out; and the coupling effects, resulted from the data voltages on the two pixel data lines 202-2, 202-4, on the common voltage Vcom can cancel each other out. Thus, the crosstalk resulted from the four data lines 202-1~202-4 in the second phase is eliminated. It is understood that the aforementioned coupling effect canceling are also applied to the rest seven phases based on the same manner.

In other words, due to being configured to have opposite swings, the coupling effects resulted from the data voltages on the two pixel data lines 202-1, 202-3 on the common voltage Vcom can cancel each other out. Likewise, the coupling effects resulted from the data voltages on the two pixel data lines 202-2, 202-4 on the common voltage Vcom can cancel each other out by configuring the two data voltages thereon in two opposite swing manners. Therefore, through employing the aforementioned data voltage polarity configuration on the data lines 202-1~202-5, the coupling effects resulted from the data lines 202-1~202-4 can cancel each other out and consequently the crosstalk associated with the four data lines 202-1~202-4 is eliminated on the display panel 200.

Although the aforementioned embodiments are exemplified by a display panel with half-source-driving structure and a display panel with a zigzag structure, it is understood that the present disclosure is not limited to the structure of the display panel. In other words, the present disclosure is applicable to those display panels having a plurality of data lines, a plurality of scan lines and a plurality of sub-pixels arranged in a matrix manner and each electrically connected to one of the data lines and one of the scan lines. In addition, the present disclosure is not limited to the aforementioned two specific patterns; in other words, the present disclosure is also applicable to other specific predetermined patterns constituted by a plurality of pixels in row; wherein at least one of the pixels has a first gray level, an adjacent pixel has a second gray level, and the first and second gray levels have a gray-level difference greater than or equal to a predetermined value.

Figure 9:
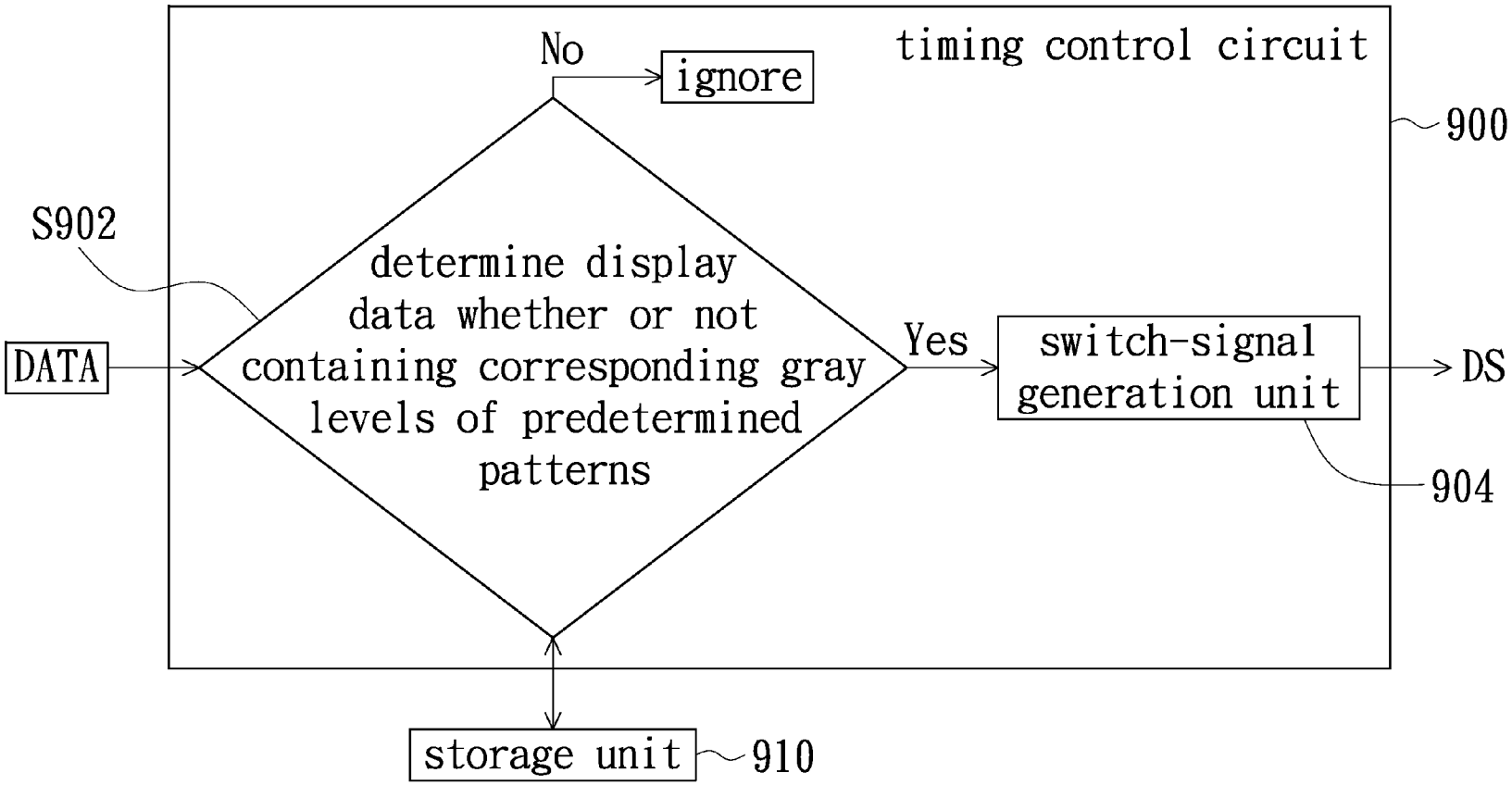
FIG. 9 is a schematic view illustrating an operation method of the timing control circuit disclosed in the present disclosure.

FIG. 9 is a schematic view illustrating an operation method of the timing control circuit disclosed in the present disclosure. As shown, the timing control circuit 900 is configured to receive display data DATA, read out corresponding gray level of a predetermined pattern from a storage unit 910, and judge the display data DATA whether or not containing the corresponding gray level of the predetermined pattern (step S902). If the display data DATA contains the corresponding gray level of the predetermined pattern, the timing control circuit 900 is configured to control a switch-signal generation unit 904 to generate a switch signal DS, which is used to converted the data driving circuit from being operated in a general-driving mean into the driven mean disclosed in the present disclosure. Alternatively, the judgment result is ignored by the timing control circuit 900 and accordingly the switch signal DS is not issued from the switch-signal generation unit 904 if the predetermined pattern is not contained in the display data DATA.

Figure 10:
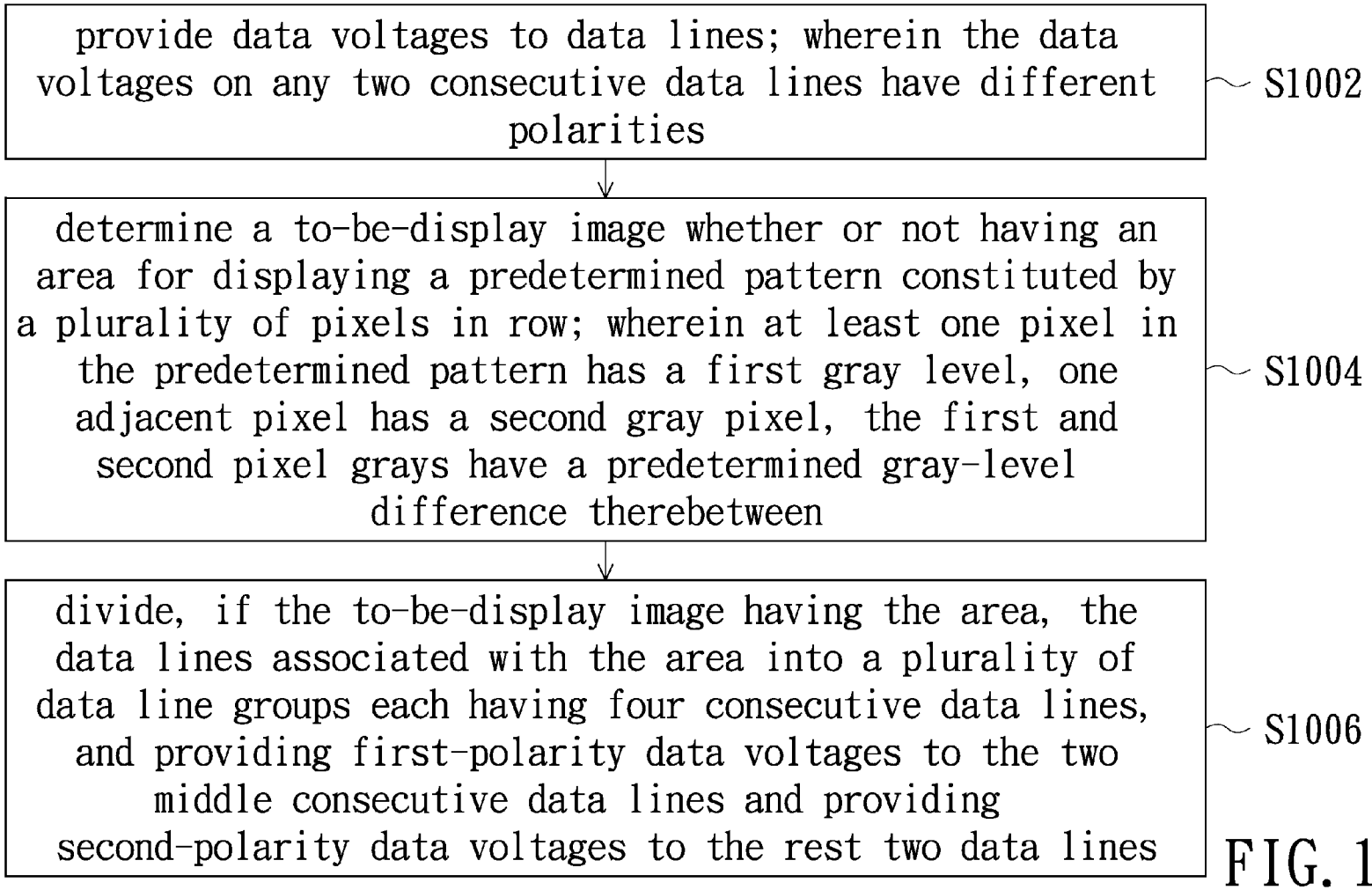
FIG. 10 is a schematic flow chart illustrating an operation method of a display apparatus in accordance with an embodiment of the present disclosure.

In addition, the operation of the display apparatus disclosed in the present disclosure can be summarized to some basic steps by those ordinarily skilled in the art. FIG. 10 is a schematic flow chart illustrating an operation method of a display apparatus in accordance with an embodiment of the present disclosure. Specifically, the display apparatus includes a display panel, and the display panel includes a plurality of data lines, a plurality of scan lines and a plurality of sub-pixels arranged in a matrix manner; wherein each sub-pixel is electrically connected to one of the scan line and one of the data lines. As illustrated in FIG. 10, the operation method includes steps of: providing data voltages with specific polarity to the data lines, wherein the data voltages on any two consecutive data lines have different polarities (step S1002); determining a to-be-displayed image whether or not having an area for displaying a predetermined pattern constituted by a plurality of pixels in row, wherein in this predetermined pattern at least one pixel has a first gray level, one adjacent pixel has a second gray pixel, and the first and second pixel grays have a gray-level difference therebetween greater than or equal to a predetermined value (step S1004); and diving, if the to-be-display image having the area for displaying the predetermined pattern, the data lines associated with the area into a plurality of data line groups each including four consecutive data lines, and supplying first-polarity data voltage to the two middle consecutive data lines and supplying second-polarity (i.e., opposite to the first polarity) data voltage to the rest two data lines in each data line group (step S1006).

In summary, according to the present disclosure, a display panel is driven initially by a general-driving mean, which indicates that the data voltages on any two consecutive data lines have different polarities, and then a to-be-displayed image is determined whether or not containing a specific pattern, which is constituted by a plurality of pixels in row; wherein in this predetermined pattern at least one pixel has a first gray level, one adjacent pixel has a second gray pixel, and the first and second pixel grays have a gray-level difference greater than or equal to a predetermined value. Afterwards, another driven mean is adopted for the driving of the display panel if the specific pattern is contained in the to-be-displayed image; specifically, the data lines associated with the specific patterns are divided into a plurality of data line groups each including four consecutive data lines, and in each data line group the data voltages on the two middle consecutive data lines have the same polarity and the data voltages on the rest two data lines have another same polarity.

Once the display panel is driven by the aforementioned driving mean, the crosstalk effects, resulted from the data lines corresponding to the specific patterns, on the common voltage can cancel each other out; and consequently the crosstalk resulted from the specific patterns is eliminated in this present disclosure.

While the disclosure has been described in terms of what is presently considered to be the most practical and preferred embodiments, it is to be understood that the disclosure needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A display apparatus, comprising:

a display panel, comprising:

a plurality of data lines;

a plurality of scan lines; and a plurality of sub-pixels arranged in a matrix manner, and each sub-pixel being electrically connected to one of the data lines and one of the scan lines;

a data driving circuit electrically connected to the data lines;

a scan driving circuit electrically connected to the scan lines; and a timing control circuit electrically connected to the data driving circuit and the scan driving circuit, wherein the timing control circuit is configured to control the scan driving circuit to drive the scan lines and control the data driving circuit to output data voltages to the data lines, the data voltages on any two consecutive data lines initially are configured to have different polarities while the data lines are being supplied with data voltages from the data driving circuit; the timing control circuit is further configured to judge a to-be-displayed image whether or not containing an area for displaying a predetermined pattern constituted by a plurality of pixels in row, wherein at least one of the pixels in the predetermined pattern has a first gray level, another one pixel adjacent to the pixel has a second gray level, and the first and second gray levels have a gray-level difference therebetween greater than or equal to a predetermined value; the timing control circuit is further configured to, if the to-be-displayed image contains the area corresponding to the predetermined pattern, divide the data lines associated with the area into a plurality of data line groups each constituted by four consecutive data lines and configure, while the data driving circuit outputs the data voltages associated with the area, data voltages on the two middle data lines in one data line group to have a first polarity and the data voltages on the rest two data lines in the same data line group to have a second polarity.

2. The display apparatus according to claim 1, wherein each same-column sub-pixel is configured to be electrically connected to one and the same data line, each same-row sub-pixels is configured to be electrically connected to two of the scan lines, and the sub-pixels electrically connected to the two scan lines are configured to have an intersecting arrangement.

3. The display apparatus according to claim 2, wherein the data voltages, sequentially supplied to any two consecutive sub-pixels in column and electrically connected to one and the same data line, are configured to have different polarities.

4. The display apparatus according to claim 2, wherein the predetermined pattern is constituted by four consecutive pixels in row, the first two pixels each have the first gray level and the following two pixels each have the second gray level.

5. The display apparatus according to claim 4, wherein in the predetermined pattern the first two pixels have a black color and the following two pixels have a white color; or, the first two pixels have a white color and the following two pixels have a black color.

6. The display apparatus according to claim 1, wherein each same-row sub-pixel is configured to be electrically connected to one and the same scan line, each same-column sub-pixels is configured to be electrically connected to two of the data lines, and the sub-pixels electrically connected to the two data lines are configured to have an intersecting arrangement.

7. The display apparatus according to claim 6, wherein the predetermined pattern is constituted by two consecutive pixels in row, the first pixel has the first gray level and the second pixel has the second gray level.

8. The display apparatus according to claim 7, wherein in the predetermined pattern the first pixel has a black color and the second pixel has a white color; or, the first pixel has a white color and the second pixel has a black color.

9. An operation method of a display apparatus, the display apparatus comprising a display panel, the display panel comprising a plurality of data lines, a plurality of scan lines and a plurality of sub-pixels, the sub-pixels being arranged in a matrix manner, and each sub-pixel being electrically connected to one of the data lines and one of the scan lines, the operation method comprising:

providing data voltages with specific polarity to the data lines, wherein the data voltages on any two consecutive data lines have different polarities;

determining a to-be-displayed image whether or not having an area for displaying a predetermined pattern constituted by a plurality of pixels in row, wherein in this predetermined pattern at least one pixel has a first gray level, one adjacent pixel has a second gray pixel, and the first and second pixel grays have a gray-level difference therebetween greater than or equal to a predetermined value; and diving, if the to-be-display image having the area for displaying the predetermined pattern, the data lines associated with the area into a plurality of data line groups each including four consecutive data lines, and supplying first-polarity data voltage to the two middle consecutive data lines and supplying second-polarity data voltage to the rest two data lines in each data line group.

10. The operation method according to claim 9, wherein each same-column sub-pixel is configured to be electrically connected to one and the same data line, each same-row sub-pixels is configured to be electrically connected to two of the scan lines, and the sub-pixels electrically connected to the two scan lines are configured to have an intersecting arrangement.

11. The operation method according to claim 10, wherein the data voltages, sequentially supplied to any two consecutive sub-pixels in column and electrically connected to one and the same data line, are configured to have different polarities.

12. The operation method according to claim 10, wherein the predetermined pattern is constituted by four consecutive pixels in row, the first two pixels each have the first gray level and the following two pixels each have the second gray level.

13. The operation method according to claim 12, wherein in the predetermined pattern the first two pixels have a black color and the following two pixels have a white color; or, the first two pixels have a white color and the following two pixels have a black color.

14. The operation method according to claim 9, wherein each same-row sub-pixel is configured to be electrically connected to one and the same scan line, each same-column sub-pixels is configured to be electrically connected to two of the data lines, and the sub-pixels electrically connected to the two data lines are configured to have an intersecting arrangement.

15. The operation method according to claim 14, wherein the predetermined pattern is constituted by two consecutive pixels in row, the first pixel has the first gray level and the second pixel has the second gray level.

16. The operation method according to claim 14, wherein in the predetermined pattern the first pixel has a black color and the second pixel has a white color; or, the first pixel has a white color and the second pixel has a black color.

* * * * *